United States Patent [19]

Nishioka

[11] 4,168,794

[45] Sep. 25, 1979

[54] DEVICE FOR CONNECTING TAPES CARRYING TAPE-FED-COMPONENTS

[75] Inventor: Yosikazu Nishioka, Osaka, Japan

[73] Assignee: Matsushita Electric Industrial Co., Ltd., Osaka, Japan

[21] Appl. No.: 913,129

[22] Filed: Jun. 6, 1978

[30] Foreign Application Priority Data

Mar. 18, 1977 [JP] Japan ..... 52/34230[U]

[51] Int. Cl.[2] ..... B25C 7/00

[52] U.S. Cl. ..... 227/155; 222/19; 227/120

[58] Field of Search ..... 227/15, 16, 19, 120, 227/140, 124, 151, 152, 154, 155

[56] References Cited

U.S. PATENT DOCUMENTS 3,581,350 6/1971 McComb ..... 227/120 X

FOREIGN PATENT DOCUMENTS 26561 4/1884 Fed. Rep. of Germany ..... 227/120

*Primary Examiner*—Roy Lake

*Assistant Examiner*—Paul A. Bell

*Attorney, Agent, or Firm*—Stevens, Davis, Miller & Mosher

[57] ABSTRACT

A device for connecting tapes carrying electronic components, adapted for use in continuous automatic feed of electronic components. The device has a base plate on which are formed aligning pins adapted to be received by corresponding aligning holes defined in the abutting ends of the tapes to be connected, and a stapler slidably attached to the base plate and adapted for connecting the tapes by the stapler nails. In use, the tapes are so placed by inserting aligning holes thereof onto the corresponding aligning pins of the base member so that the trailing end of the preceding tape and the leading end of the oncoming tape may correctly abut each other. Then, the stapler is operated in the usual manner so as to connect the abutting ends of the tape by the stapler nails. Since the stapler is slidable in the breadthwise direction of the tape, the stapler nails are driven at a plurality of points over the breadth of the tapes, thereby rigidly connecting the tapes at the abutting ends.

3 Claims, 5 Drawing Figures

DEVICE FOR CONNECTING TAPES CARRYING TAPE-FED-COMPONENTS

BACKGROUND OF THE INVENTION

The present invention relates to a device for connecting tapes carrying electronic components, adapted for use in automatic continuous feed of these electronic components.

In most cases, the automatic continuous feed of electronic components is carried out by making use of a series of tapes each of which carrying the electronic components to be fed. Since each tape has a definite length, it is necessary to connect the leading end of the next electronic-components-carrying tape to the trailing end of the preceding electronic-component-carrying tape, at each time of termination of the successive tapes.

Conventionally, this connection of the electronic-component-carrying tapes has been made in quite inefficient manner, as will be detailed later.

SUMMARY OF THE INVENTION

It is therefore an object of the invention to provide a device for connecting the electronic-component-carrying tapes capable of affording an efficient, strong and safe connection of these tapes.

To this end, according to the invention, there is provided a device for connecting tapes carrying tape-fed-components comprising: a base plate having aligning projections adapted to be received by corresponding aligning holes of the tapes, and a recess extending in the middle portion of the base plate, the recess being opened at its front side and provided with guide grooves formed in its both side walls; and a stapler having a base member of which front end portion is slidably received by the recess while the lateral side portions of which being guided by the guide grooves of the base plate.

The above and other objects, as well as advantageous features of the invention will become more clear from the following description of the preferred embodiments taken in conjunction with the accompanying drawings.

DESCRIPTION OF THE PREFERRED EMBODIMENTS

Figure 1:
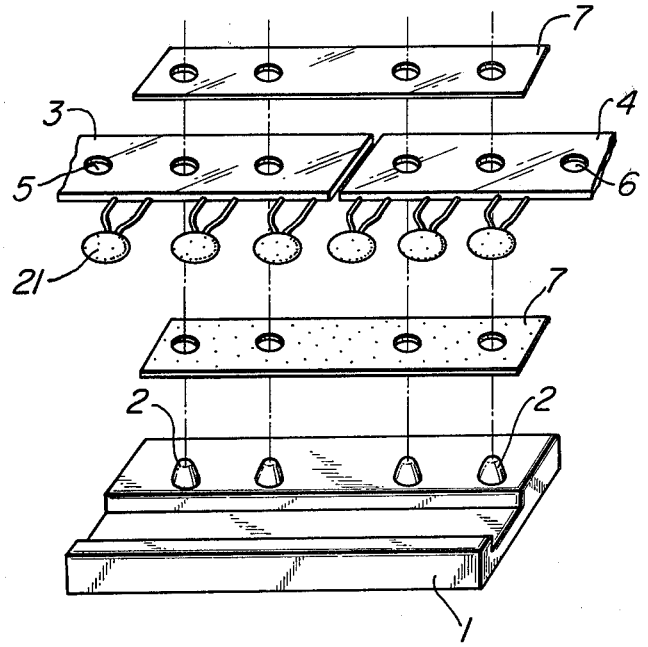
FIG. 1 PRIOR ART
FIG. 1 is an exploded perspective view of a jig conventionally used in the connecting work for connecting the electronic-component-carrying tapes.

Before turning to the description of the preferred embodiment, a description will be made as to the jig conventionally used in the tape connecting work, with specific reference to FIG. 1.

The conventionally used jig generally designated at a reference numeral 1 has a plurality of pins 2 formed on the upper surface thereof. In connecting the electronic-component-carrying tapes 3, 4, the tapes 3, 4 are placed on the jig 1, that is; the pins 2 are received by corresponding locating bores 5, 6 pierced through these tapes 3, 4 so as to have the trailing end of the preceding tape 3 and the leading end of the next tape 4 abutted against each other. Then, separately prepared joint tapes, 7, 7 are bonded to the upper and the lower sides of these tapes 3, 4, across the abutting ends.

This conventional technique of connecting tapes involves two substantial problems: one is that the joint tapes 7, 7 have to be separately prepared, while the other resides in a troublesome work of turning the tapes upside down after bonding one joint tape 7 to the upper surfaces of the tapes 3, 4, for applying the other joint tape 7 to the lower side of these tapes.

For these reasons, the tape connecting work has been rendered quite inefficient.

It is remarkable that the above described problem of the prior art can fairly be avoided and an efficient, strong and safe connection is ensured by the device of the invention, as will be seen from the following description.

Figure 3:
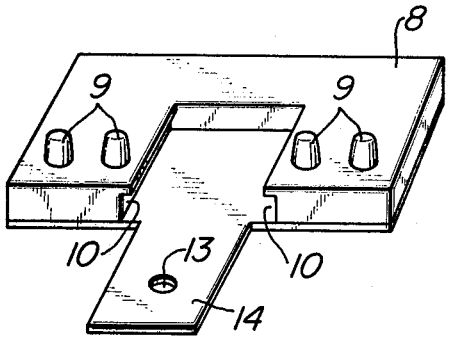
FIG. 3 is a perspective view of an essential part of the device as shown in FIG. 2.

Referring to FIG. 3, a device for connecting the electronic-component-carrying tapes of the invention has a base plate 8 having a plurality of aligning pins 9 formed on the upper surface thereof. The base plate 8 has a recess formed at its middle portion. The recess is made to open through the front wall of the base plate 8. Both lateral side walls of the recess are partially recessed to form guide grooves 10.

Figure 2:
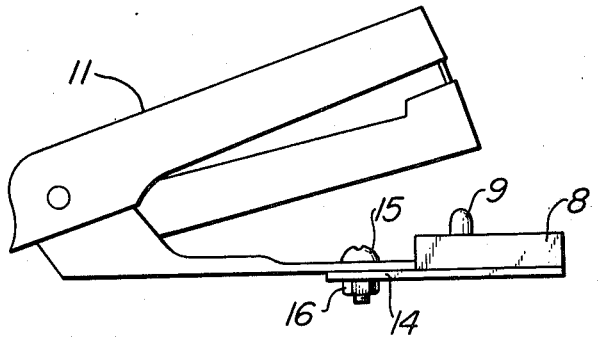
FIG. 2 is a side elevational view of a device for connecting the electronic-components-carrying tapes in accordance with the invention.

Referring now to FIG. 2, a stapler 11 has a base member adapted to be slidably received by the recess of the base plate 8 in such a manner that the both lateral side edges of the base member are slidingly guided by the guide grooves 10, 10.

Figure 4:
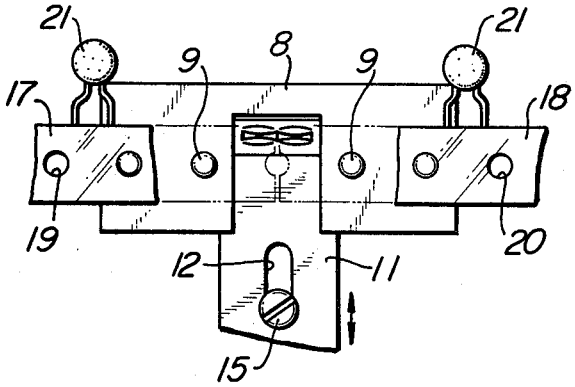
FIG. 4 is an illustration of the essential part, for explaining the manner in which the device is used.

As will be most clearly seen from FIG. 4, an elongated bore 12 is formed through the base member of the stapler 11, while a bracket 14 extending forwardly and rigidly from the bottom of the recess of the base plate 8 has a through bore 13.

The base member of the stapler 11 is mounted on the bracket 14 and adjustably fixed to the latter by means of a bolt 15 extending through the bores 12, 13 and a nut 16 screwed to the bolt 15.

In use, the tapes 17, 18 to be connected to each other are placed on the base plate 8, such that the aligning pins 9, 9 formed on the base plate 8 are received by corresponding aligning holes 19, 20 pierced through the thickness of the tapes 17, 18, thereby to have the trailing end of the tape 17 and the leading end of the tape 18 abut each other.

Then, the stapler is operated in the manner known per se, so as to connect the ends of the tapes 17, 18 to each other by the stapler nails. Since the stapler 11 is slidable in the breadthwise direction of the tapes 17, 18, the connection is made at a plurality of points over the breadth of the abutting ends.

Figure 5:
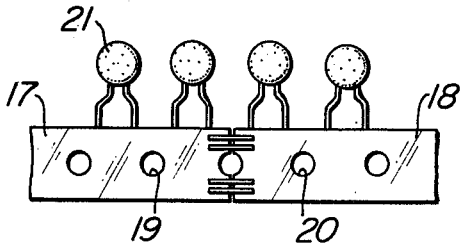
FIG. 5 is a front elevational view of tapes connected by means of the device as shown in FIG. 2.

Consequently, two tapes 17, 18 are connected to each other strongly and safely, as shown in FIG. 5.

In the drawings, reference numeral 21 denotes electronic components carried by the electronic-component-carrying tapes 17, 18.

From the foregoing description of the preferred embodiment, it will be seen that the tape connecting work is rendered quite simple and efficient by the use of the device in accordance with the invention. In addition, it is not necessary to prepare specific joint tapes, because of the efficient use of a stapler. Consequently, the cost required for the tape connecting work is reduced advantageously.

I claim:

1. A device for connecting tapes carrying tape-fed-components, comprising:

(a) a base plate having aligning projections adapted to be received by aligning holes of said tapes, and a recess formed in the middle portion of said base plate, said recess being opened in the front wall of said base plate, the lateral side walls of said recess being partially recessed to form guide grooves; and (b) a stapler having a base member adapted to be slidably received by said recess with its both lateral sides guided by said guide grooves.

2. A device as set forth in claim 1, wherein said base plate has a bracket extending forwardly from the bottom of said recess, for supporting said base member of said stapler.

3. A device as set forth in claim 2, wherein said bracket and said base member are provided with through-bores at least one of which is elongated in the breadthwise direction of said tapes, whereby said stapler is fixed to said bracket adjustably in the breadthwise direction of said tapes, by means of a bolt-and-nut associated with said through-bores.

* * * * *